US005921467A

United States Patent [19]

Larson

[11] Patent Number: 5,921,467

[45] **Date of Patent: *Jul. 13, 1999**

[54] FORCED AIR HELMET HEATER AND DEFROSTER SYSTEM FOR SPORT AND UTILITY VEHICLES

[76] Inventor: David J. Larson, 13995 263rd St. North, Lindstrom, Minn. 55045

[ * ] Notice: This patent issued on a continued prosecution application filed under 37 CFR 1.53(d), and is subject to the twenty year patent term provisions of 35 U.S.C. 154(a)(2).

[21] Appl. No.: 08/691,932

[22] Filed: Aug. 5, 1996

[51] Int. Cl.[6] ..... B60H 1/02

[52] U.S. Cl. ..... 237/12.3 C; 165/46

[58] Field of Search ..... 237/12.3 C; 165/46

[56] References Cited

U.S. PATENT DOCUMENTS

| | | | |
|---|---|---|---|
| 3,280,896 | 10/1966 | Goodson et al. | 34/90 |
| 3,383,778 | 5/1968 | Goodman | 34/90 |
| 4,018,380 | 4/1977 | Baier | 237/12.3 C |
| 4,418,745 | 12/1983 | Roehr | 165/46 |
| 4,502,480 | 3/1985 | Yamamoto | 128/201.15 |
| 5,146,757 | 9/1992 | Dearing | 62/61 |
| 5,394,566 | 3/1995 | Hong | 2/424 |

OTHER PUBLICATIONS

Electrical Heating Helmet Shields, *SnoRider*, pp. 12–13.
Simpson Sidewinder Helmets (Advertisement), p. 31.
Simpson Helmet (Advertisement), *Simpson Product Information*, p. 24.
Simpson Helmet (Advertisement), *Simpson Race Products*, cover page and p. 71.

*Primary Examiner*—Henry A. Bennett
*Assistant Examiner*—Derek S. Boles
*Attorney, Agent, or Firm*—Gerald E. Helget; Mackall, Crounse & Moore, PLC

[57] ABSTRACT

The forced air helmet heater and defroster system for sport and utility vehicles begins with a small motor driven blower. This blower is mounted or fastened to the vehicle and adapted to draw in cold, fresh air from the exterior of the vehicle and force it through a heat source. The heat source warms or tempers this cold fresh air. Then, depending on system configuration, the air exiting the heat source is either forced to an insulated helmet delivery conduit equipped with a break-away connection on the inlet end and a diffuser on the exit end, or it can first be routed to an optional temperature control junction and then to the insulated helmet delivery conduit. The vehicle rider may then place the delivery conduit's exit diffuser between the interior side of the helmet and their cheek or chin whereby the expelling warm air flushes the helmet's interior thus warming the rider's face and breathing air as well as keeping the rider's face shield and eyeglasses defrosted and fog free.

20 Claims, 4 Drawing Sheets

FORCED AIR HELMET HEATER AND DEFROSTER SYSTEM FOR SPORT AND UTILITY VEHICLES

BACKGROUND OF THE INVENTION

The invention relates to helmets, and more particularly, to a forced air helmet heater and defroster system for sport and utility vehicles such as all-terrain vehicles and snowmobiles.

Because snowmobiling is a winter activity it is necessary for snowmobile riders to be out in cold, very cold or even sub zero temperatures to enjoy their pastime. To help shield their face from the cold and for safety reasons most riders wear a full-face helmet with a face shield while snowmobiling. However, even with the helmet and shield in place, a rider's face and head can become uncomfortably and even painfully cold drastically diminishing the enjoyment a rider can experience while out in nature and even cause respiratory problems when the rider inhales such cold air, particularly in cases of respiratory diseases.

Additionally, many snowmobile riders find that the interior of their face shield and eyeglass lenses tend to "fog up" and "frost over" when the warm humid air they exhale hits the cold surfaces of their face shield and eyeglasses. This can cause serious safety problems by blurring and diminishing the rider's field of vision. While there are a number of liquid defogging solutions that can be applied to the shield, this is only a temporary fix, fogging will reoccur when the defogging solution wears off. There are also electrically heated face shields available for helmets, however, these are very low wattage devices and do not provide enough heat to sufficiently warm the supply of fresh breathing air that must continuously flush through a helmet to keep moisture and condensation to a minimum. Thus, while these electrically heated face shields may provide relief from face shield fogging they may not prevent a rider's eyeglasses from fogging, especially in sub zero temperatures, and do little to temper or warm the breathing air within the helmet before the rider inhales it.

These same problems can occur for ATV (all-terrain vehicle) riders or any other riders whose vehicle exposes them to the elements.

For the foregoing reasons there is a need for a system that will both heat and defrost the interior of a helmet.

SUMMARY OF THE INVENTION

The forced air helmet heater and defroster system for sport and utility vehicles begins with a small motor driven blower. This blower is mounted or fastened to the vehicle and adapted to draw in cold, fresh air from the exterior of the vehicle and force it through a heat source. The heat source warms or tempers this cold fresh air. Then, depending on system configuration, the air exiting the heat source is either forced to an insulated helmet delivery conduit equipped with a break-away connection on the inlet end and a diffuser on the exit end, or it can first be routed to an optional temperature control junction and then to the insulated helmet delivery conduit. The vehicle rider may then place the delivery conduit's exit diffuser between the interior side of the helmet and their cheek or chin whereby the expelling warm air flushes the helmet's interior thus warming the rider's face and breathing air as well as keeping the rider's face shield and eyeglasses defrosted and fog free.

An object and advantage of the invention is that the forced air helmet heater and defroster system for sport and utility vehicles is able to keep the vehicle rider's face warm and their face shield and eyeglass lenses defrosted by providing a constant supply of warmed or tempered air to the interior of their helmet.

A further object and advantage of the invention is that the forced air helmet heater and defroster system for sport and utility vehicles is a system that can easily be adapted to fit many types of vehicles due to its ability to make use of the vehicle's existing components, such as the electrical system, exhaust system, engine coolant system as well as the vehicle's control panel and dashboard.

A further object and advantage of the invention is that the forced air helmet heater and defroster system for sport and utility vehicles has the flexibility to select between several heat sources. These being electric heat, exhaust system heat, or engine coolant water heat. The decision of system configuration is based upon the particular vehicle model components and specifications as well as the user's preference.

A further object and advantage of the invention is that the forced air helmet heater and defroster system for sport and utility vehicles has the flexibility to select between an electronic, bimetallic, or manual temperature control junction, or no temperature control junction at all, which is the most economical and practical. The decision of system configuration is based upon the particular vehicle model's components and specifications as well as the user's preference.

A further object and advantage of the invention is that the forced air helmet heater and defroster system for sport and utility vehicles helmet delivery conduit has an insulated casing and is equipped with a break-away connection that allows the delivery conduit to quickly and easily break free from the vehicle. Such an enhancement protects the rider from entanglement with the delivery conduit should the rider have an accident and be thrown from the vehicle.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE PREFERRED EMBODIMENTS

Figure 1:
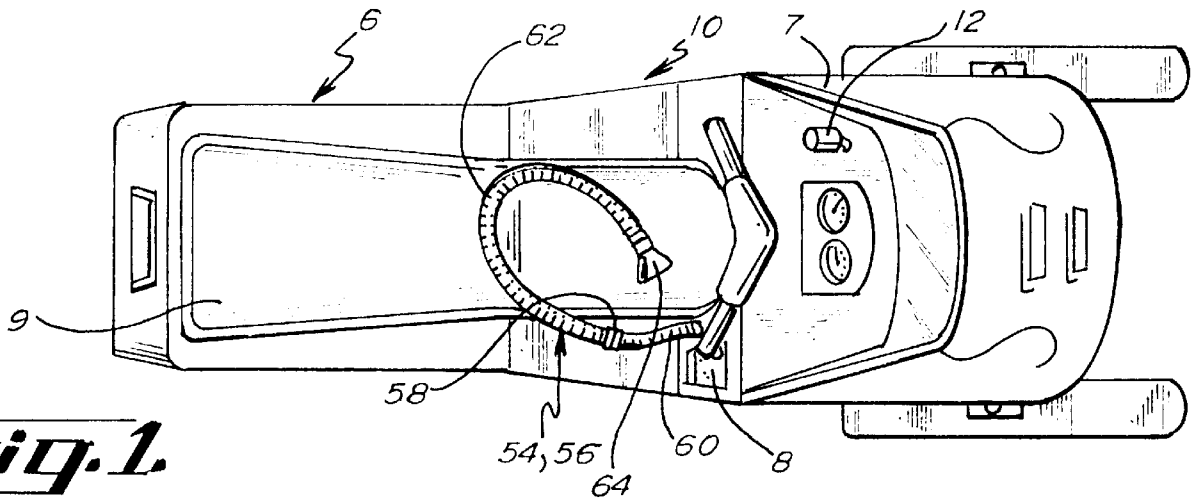
FIG. 1 is a top plan view of a snowmobile with a forced air helmet heater and defroster system for sport and utility vehicles utilizing an exhaust system heat source clamped to the vehicle's muffler and an optional electronic temperature control junction.
Figure 2:
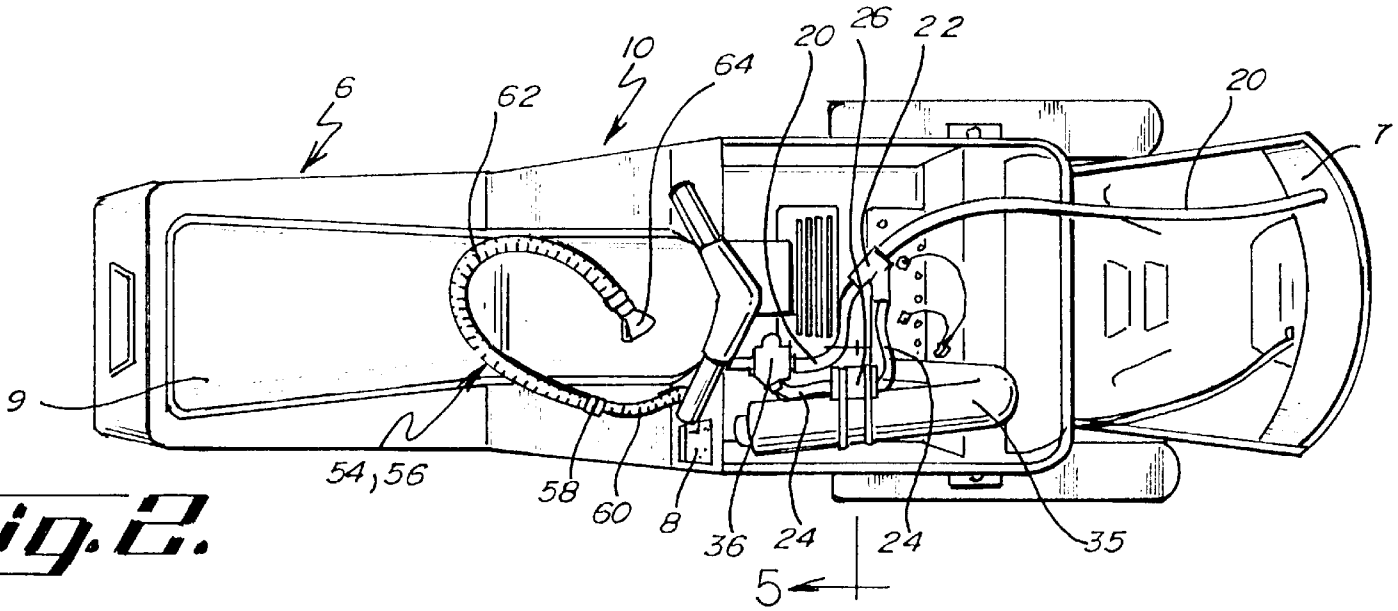
FIG. 2 is a top plan view of the snowmobile in FIG. 1 with the hood open showing the forced air helmet heater and defroster system for sport and utility vehicles.
Figure 9:
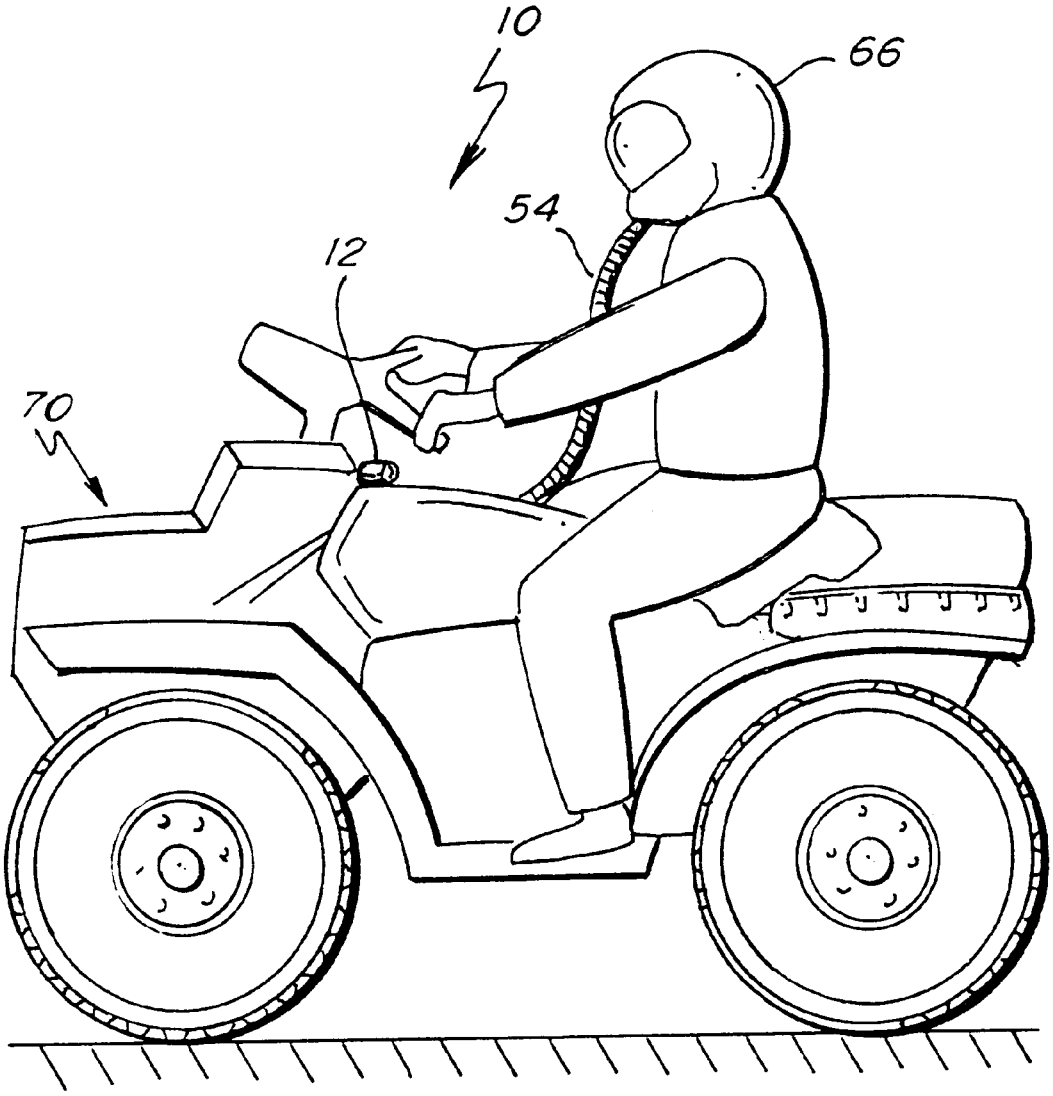
FIG. 9 depicts the forced air helmet heater and defroster system for sport and utility vehicles as used on an ATV (all-terrain vehicle).
Figure 10:
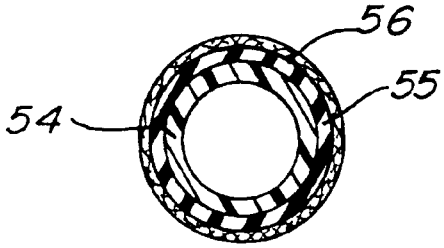
FIG. 10 is a cross-sectional view of the delivery conduit.

The forced air helmet heater and defroster system for sport and utility vehicles 10, see generally FIGS. 1, 2 and 9, generally comprises a blower means 12, connective hosing 20, 24, an air heating means 26, a delivery conduit 54 and an air diffuser 64. The air heating means 26 may further comprise a temperature control means 36.

Figure 8:
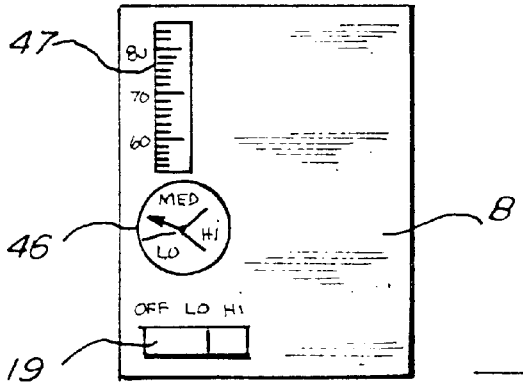
FIG. 8 depicts the control elements of the forced air helmet heater and defroster system for sport and utility vehicles.
Figure 4:
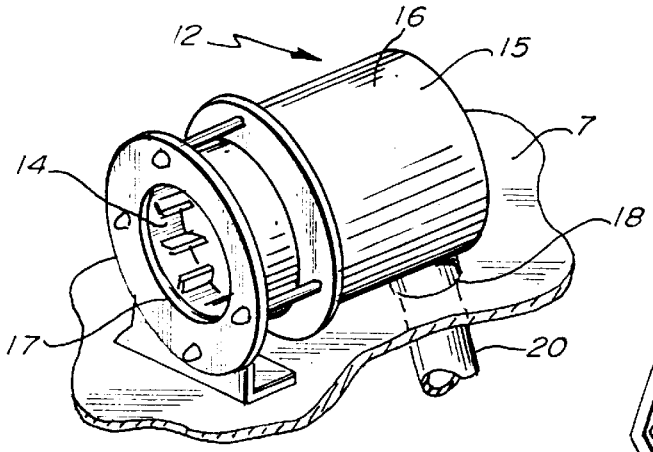
FIG. 4 is a perspective view of the enclosed blower fan and motor.

The blower means 12 includes a blower fan 14, a blower motor 15, a fan/motor casing 16 and a variable speed fan motor switch 19. (See FIGS. 1, 4 and 8.) The blower fan 14 is attached to the drive shaft of the blower motor 15. A fan of approximately two inches in diameter is appropriate and a small 12 volt direct current 11,500 rpm permanent magnet motor may be used. The combination fan 14 and motor 15 are housed in a casing 16, the casing 16 having a side opening 17 to allow cold fresh air in and a bottom opening 18 so that the cold fresh air may be forced downward from the fan 14, see FIG. 4, to the air heating means 26. The fan/motor casing 16 is mounted atop the hood 7, FIG. 1, of the snowmobile 6 covering a pre-drilled hole of large enough diameter to accommodate the volume of air flow needed to operate the invention properly. A diameter of ¾ inch is suggested. The variable speed fan motor switch 19 is mounted on the existing snowmobile control panel, see FIG. 8. The fan motor switch 19 and the fan motor 15 are wired into the snowmobile's existing electrical system accommodating between the alternating current of the electrical system and the direct current requirements of the motor 15 and switch 19.

The cold fresh downward forced air from the blower fan 14 is directed through low temperature hosing 20 to an aluminum Y-junction 22, see FIG. 2. At the Y-junction 22 the cold fresh air is divided, one half going to the air heating means 26 via high temperature hosing 24 and the other half going directly to the temperature control means 36 via additional low temperature hosing 20. The low temperature hosing 20 is a one inch diameter all-polyethylene hose having a smooth interior with a temperature rating of −30° F. to 160° F.; it is a type J-11 hose available from Hi-Tech Hose Inc., 2111 South Standard Ave., Santa Ana, Calif. 92707. The high temperature hosing is one inch in diameter and is a single ply fiberglass impregnated with silicone rubber having a temperature range of −80° F. to 600° F. It is a type SSF Silflex hose available from Baldwin Supply Company, 601 11th Avenue South, Minneapolis, Minn. 55415.

Figure 5:
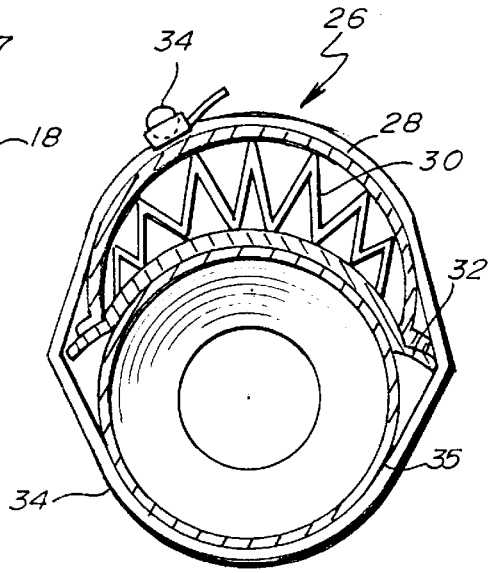
FIG. 5 is a cut away view along line 6—6 of FIG. 2 depicting a heat exchanger clamped to a snowmobile's muffler.

The air heating means 26, see generally FIGS. 2 and 5, comprises a heat exchanger 28 containing a plurality of fins 30, a heat exchanger shield 32 and a plurality of clamps 34. The heat exchanger 28 is set atop the shield 32 whereby both are clamped 34 to the snowmobile's existing muffler 35 so that the heat exchanger 28 and fins 30 may absorb the heat from the muffler's exterior surface. The cold fresh air passing through the heat exchanger 28 and over the fins 30 is thereby heated and exits through additional high temperature hosing 24 to the temperature control means 36. The heat exchanger fins 30 are ideally made of aluminum or other heat conductive materials, the shield 32 is ideally made of a thin non-corrosive material such as brass or stainless steel, and the clamps 34 are generally stainless steel hose clamps.

Figure 6:
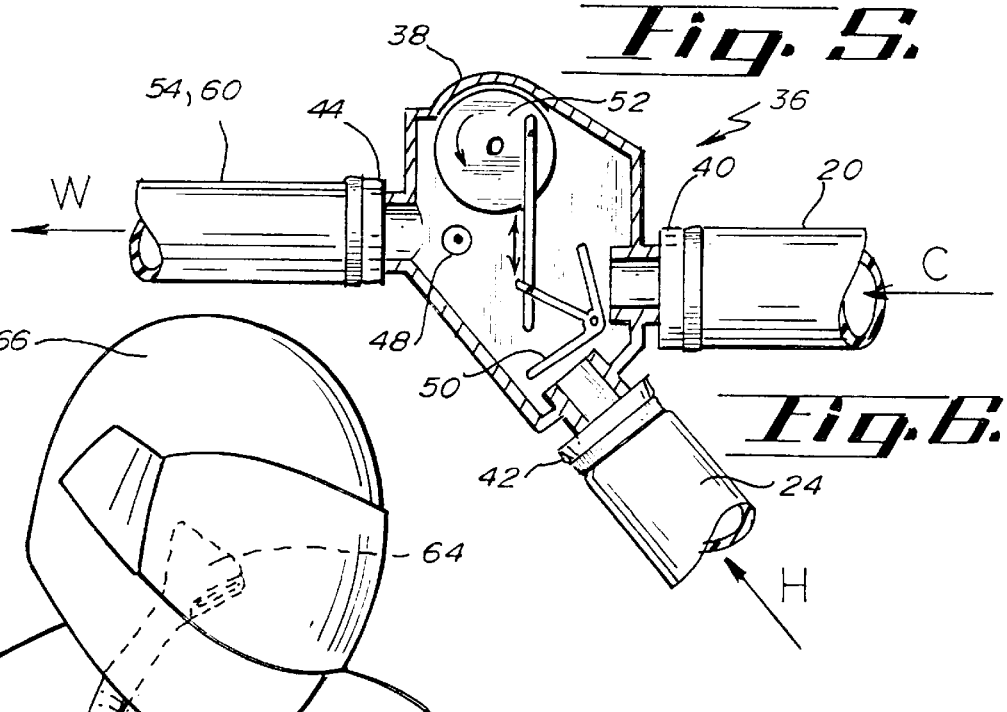
FIG. 6 is a close-up view of an electronic temperature control junction.

The temperature control means 36, see generally FIGS. 2 and 6, is an electronic temperature control junction 38 having a cold fresh air inlet 40, a warm air inlet 42, and a warm air outlet 44. The junction itself is ideally made of aluminum. The inlets 40 and 42 are controlled by a servo-motor 52 driven butterfly 50. A typical five volt direct current servo-motor available from many hobby stores will suffice and is wired into the snowmobile's existing electrical system accommodating between the alternating current of the vehicles electrical system and the direct current requirements of the servo-motor 52. The butterfly valve 50 is ideally made of aluminum and brass.

In operation, the electronic temperature control junction 38 is controlled by an electronic circuit. The user enters a temperature set-point by setting a control panel mounted, calibrated temperature switch 46 to a comfortable temperature setting. This set-point is compared to the temperature read by a probe 48 within the temperature control junction itself. If the temperature within the junction 38 is low compared to the user set-point temperature the servo-motor 52 is directed to move the butterfly valve 50 so that cold air inlet 40 gap is narrowed thereby widening the warm air inlet 42 gap and thus, raising the temperature within the junction 38. If the temperature within the junction 38 is high compared to the set point, the opposite reaction occurs. The temperature comparison process is an ongoing, continuously repeating process, never stopping unless the temperature switch 46 is turned to off, at which point the butterfly closes off the warm air junction completely and out-put air temperature goes to maximum cold or ambient temperature.

The temperature controlled air is forced through the outlet 44 of the temperature control junction 38 by virtue of the continuous operation of the blower fan 14 to the delivery conduit 54, FIGS. 2 and 6. The delivery conduit can be a three-quarter inch diameter hose similar to the low temperature hose 20 described above. However, a thermoplastic rubber hose with a smooth interior, such as the ARH hose with a temperature range of −60° F. to 275° F. available from Hi-Tech Hose Inc., 2111 South Standard Ave., Santa Ana, Calif. 92707, can also be used and is actually more appropriate in systems that do not utilize a temperature control junction due to the higher operational temperature limit.

The delivery conduit 54 exits the underside of the snowmobile hood 7 in the gap between the hood 7 and the seat 9, see FIGS. 1 and 2. The delivery conduit 54 is wrapped in a dual layer casing 56 wherein one layer 55 is THINSULATE® insulation and the other a durable nylon sport cloth, both available from a local fabric store. The casing not only helps to insulate and retain the heat within the hose 54 but also helps prevent damage to the exterior of the hose 54 itself as well as improve appearance.

The delivery conduit 54 is actually divided into two segments, a leader hose 60 with one end clamped to the temperature control junction 38 and a follower hose 62, FIGS. 1 and 2. Connecting the two segments is a break-away connection 58. The break-away connection is made of a piece of leather, or other durable material, sewn into a tube configuration. One end of the leather tube is tightly clamped or bound to one end of the follower hose 62. The other end of the leather tube is fastened by hook and loop means, such as VELCRO®, to the loose end of the leader hose 60. The break-away connection 58 is very important in an emergency situation, should the snowmobile rider be thrown from his sled or have to jump off the sled the follower hose 62 will easily separate from the leader hose 60 thereby freeing the rider from the sled and avoiding entanglement with the hose 54.

Figure 7:
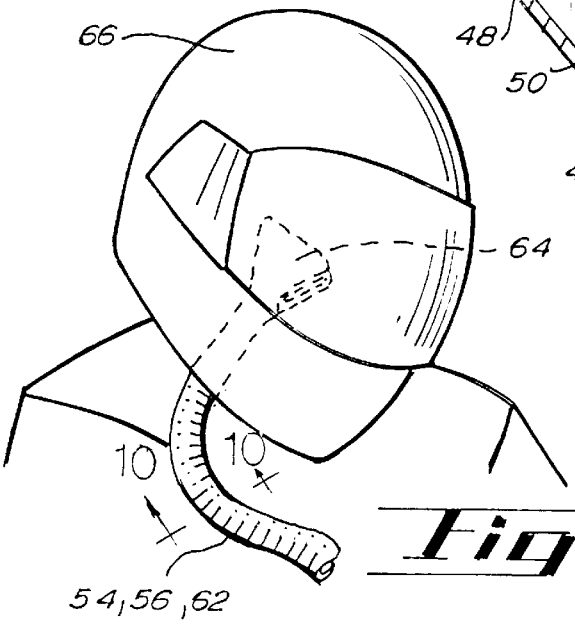
FIG. 7 is a view of the forced air helmet heater and defroster system for sport and utility vehicle's delivery conduit diffuser inside an actual helmet with a shield.

Attached to the free end of the follower hose 62 is an air diffuser 64, FIGS. 1, 2 and 7. The diffuser 64 is also made of leather or other durable material. One end of the diffuser is tube shaped and is secured by clamping or other appropriate means, to the free end of the follower hose 62. The tube shape of the air diffuser 64 widens to an almost triangular shape at is open end whereat the warmed air can escape. The air diffuser 64 is placed inside the user's helmet 66 between the interior side of the helmet 66 and the user's cheek or chin.

Figure 3:
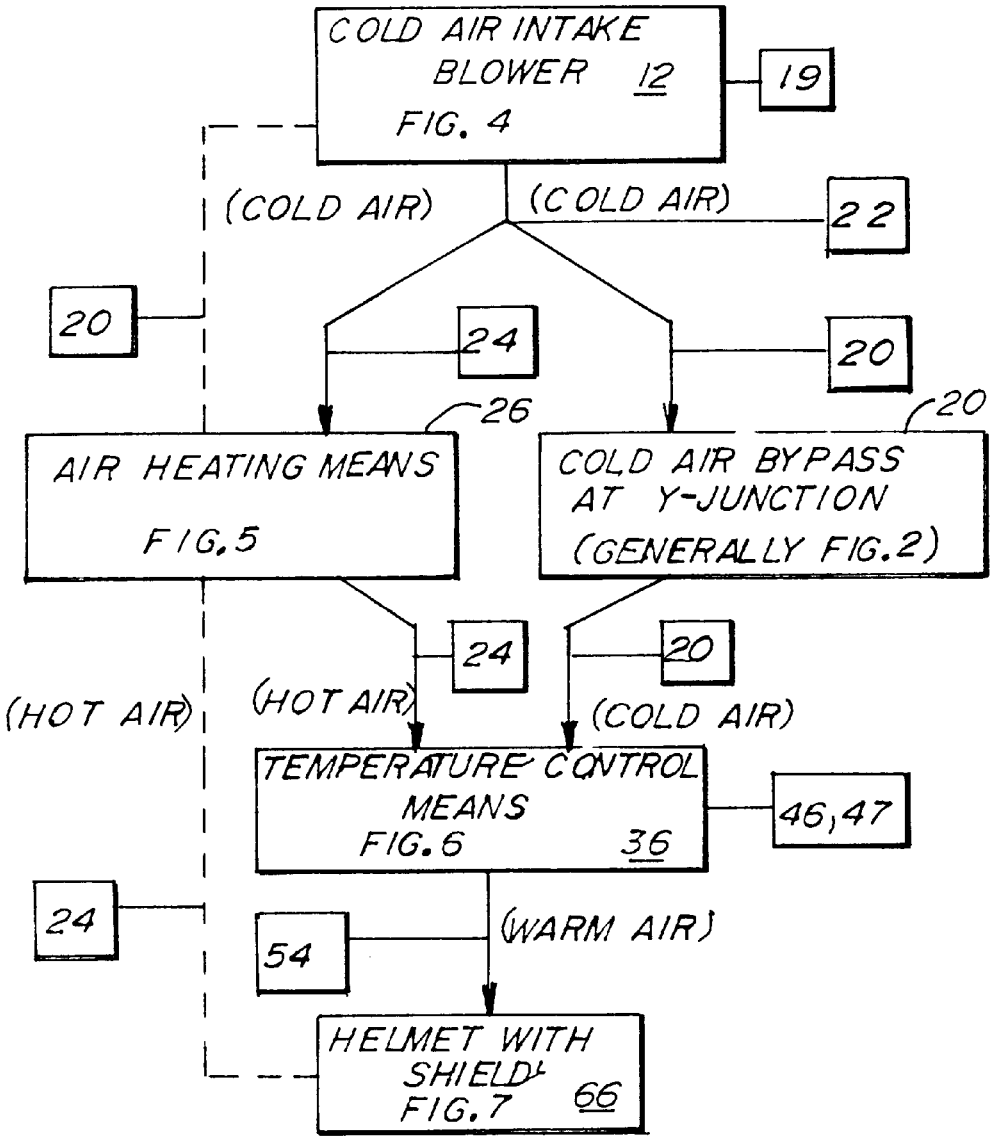
FIG. 3 is a flow diagram of the operation of the forced air helmet heater and defroster system for sport and utility vehicles.

To employ the forced air helmet heater and defroster system 10 one need only move the blower fan switch 19 to its on position, select a temperature set-point by moving the temperature switch 46 to a desired setting, and insert the air diffuser 64 into the helmet 66. In so doing, the blower fan 14 takes in cold fresh air and forces a portion of it directly to the temperature control junction 38 while forcing the other portion to the heat exchanger 28. At the heat exchanger 28, the air is warmed by passing over heated fins 30 which have absorbed their heat from the surface of snowmobile's existing muffler 35. The warmed air is then forced, by continuous operation of the blower fan 14, to the temperature junction 38. At the temperature junction 38, the warm air and the cold air are proportionately mixed according to the temperature set-point, the temperature monitored by an electronic thermostat circuit. The actual temperature of the expelled air can be read on an LED bar graph display 47 mounted on the control panel 8. The proportionately mixed warm air from the temperature junction 38 is then forced by continuous operation of the blower fan 14 through the delivery conduit 54 to the air diffuser 64. At the air diffuser 64, the warm air is expelled into the user's helmet 66 thereby heating the user's face and defrosting the user's helmet face shield and eyeglasses. See FIG. 3 for a flow diagram depicting the operation of the forced air helmet heater and defroster system 10 for sport and utility vehicles.

There are a number of variations which may be considered in the forced air helmet heater and defroster system 10. First, a thermal fuse or breaker can be installed in the airstream between the delivery hose 54 and the heat source of any of the various system configurations (discussed below) for the purpose of interrupting the power to the blower fan motor 15 in the event of a high temperature situation.

Next the heat exchanger 28 clamped to the snowmobile's muffler 35 or exhaust system can be replaced by an electric heating element although the power drain on the snowmobile's electrical system is a serious consideration. When an electric heating element is used, the element itself is electronically controlled thereby eliminating the need for the temperature control junction 38 to proportionately mix warm and old air, however a thermal fuse is required in this configuration for the purpose of interrupting power to the heating element in the case of a blower malfunction. The electronic control for an electric heater element should also include a power regulating circuit for the purpose of maintaining the vehicle's electrical system at the proper voltage, generally 12.6–13 volts. An additional variation of the electrical heat source system is to combine the blower fan 14 and motor 12 with the electric heating element into one compact unit that can be mounted at a convenient location on the vehicle's interior, exterior or handlebars, thus eliminating the cold air connective hosing 20 and the high temperature hosing 24. Additionally, in a liquid cooled snowmobile, a heater core heat exchanger can be used in place of the muffler or exhaust mounted heat exchanger 28.

Finally, it is possible to replace the electronically controlled servo-motor 52 of the temperature control junction 36 with either a bimetallic control whereas an adjustable bimetallic device is mounted in the exiting airstream 48 of the temperature control junction 36 and connected to the butterfly valve 50 as to control air mixture temperature, or the servo-motor 52 can be replaced with a simple cable or linkage connected to the butterfly valve 50 to allow the rider to manually control the butterfly valve 50 position. It is also possible to eliminate the temperature control junction 36 completely. In so doing, all the cold air from the blower fan 14 passes directly to the heat exchanger 26 and out to the delivery conduit 54 and diffuser 64 without any thermostatic control, see FIG. 3 for alternative flow diagram in phantom. This configuration does not provide constant output temperature levels in systems utilizing the muffler 35 or exhaust system as the heat source and thereby limits the system to narrower operating temperature parameters and requires a more precisely sized heat exchanger for a given vehicle model. However, this is the most economical and practical configuration for most vehicles and, when properly designed and installed, will give satisfactory operation and protection. Also, limited temperature control is provided in this configuration by partially or fully removing the delivery conduit's outer casing insulation 56 thus allowing some of the heat to dissipate through the walls of the delivery conduit 64 to the surrounding ambient air while enroute to the heat diffuser 64.

FIG. 9 depicts the forced air helmet heater and defroster system 10 as it is used on an ATV 70. The operation of the forced air helmet heater and defroster system 10 as used on the ATV 70 is nearly identical to the operation of the forced air helmet heater and defroster system as used on the snowmobile 6 taking into account the slight variation of vehicle mechanical and electrical components. The ATV 70 embodiment can also incorporate all the alternatives and variations mentioned.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A forced air helmet defroster system for a helmet with a face shield used with sport utility vehicles comprising:

(a) blower means, the blower means mounted to the sport/utility vehicle adapted to draw in cold outdoor air, (b) a cold air conduit, the conduit connected to the blower means;

(c) air heating means, the air heating means connected to the cold air conduit, the air heating means adapted to warm the cold outdoor air, the cold outdoor air driven to the air heating means by the blower means; and (d) a delivery conduit, the delivery conduit connected to the air heating means and extendable to a helmet worn by a rider of the vehicle for directing warm air at the face shield to defrost the face shield, the warm air driven through the delivery conduit by the blower means, wherein the delivery conduit has an insulation layer and further comprises a break away connection adapted to allow the delivery conduit to break free from between the vehicle and the helmet.

2. The forced air helmet defroster system for sport/utility vehicles of claim 1, wherein the air heating means further comprises an electrically powered heating element.

3. The forced air helmet defroster system for sport/utility vehicles of claim 1, wherein the air heating means further comprises a heat exchanger attached to a sport/utility vehicle's exhaust system.

4. The forced air helmet defroster system for sport/utility vehicles of claim 1, wherein the air heating means further comprises an engine coolant water heat exchanger.

5. The forced air helmet defroster system for sport/utility vehicles of claim 1, wherein the blower means is thermostatically controlled.

6. The forced air helmet defroster system for sport/utility vehicles of claim 3 wherein the air heating means further comprises a temperature junction wherein the cold outdoor air is proportionately combined with the warm air.

7. The forced air helmet defroster system for sport/utility vehicles of claim 6, wherein the temperature junction further comprises an electrically powered servo-motor driven butterfly valve adapted to control the proportion of cold outdoor air to warm air.

8. The forced air helmet defroster system for sport/utility vehicles of claim 7, wherein the electric power is supplied by the vehicle's existing electrical system.

9. A forced air helmet defroster system for a helmet with a face shield used with sport/utility vehicles comprising:

(a) a blower means, the blower means mounted to the sport/utility vehicle adapted to draw in cold outdoor air;

(b) a cold air intake conduit, the intake conduit connected to the blower means;

(c) air heating means, the air heating means connected to the intake conduit, the cold outdoor air driven to the air heating means by the blower means, the air heating means adapted to warm the cold outdoor air;

(d) a temperature control means, the temperature control means connected to the intake conduit and to the air heating means, the temperature control means adapted to proportionately combine the cold outdoor air and the warm air, the cold outdoor air and the warm air driven to the temperature control means by the blower means; and (e) a delivery conduit, the delivery conduit connected to the temperature control means and extendable to a helmet worn by a rider of the vehicle for delivering the combined air to defrost the helmet, the warm air driven through the delivery conduit by the blower means, wherein the delivery conduit further comprises a break away connection adapted to allow the delivery conduit to break free from the vehicle and an insulation layer.

10. The forced air helmet defroster system for sport/utility vehicles of claim 9, wherein the air heating means further comprises an electrically powered heating element.

11. The forced air helmet defroster system for sport/utility vehicles of claim 9, wherein the air heating means further comprises a heat exchanger attached to a vehicle's exhaust system.

12. The forced air helmet defroster system for sport/utility vehicles of claim 9, wherein the air heating means further comprises an engine coolant water heat exchanger.

13. The forced air helmet defroster system for sport/utility vehicles of claim 9, wherein the temperature control means further comprises an electrically powered servo-motor driven butterfly valve adapted to control the proportion of cold outdoor air to warm air.

14. The forced air helmet defroster system for sport/utility vehicles of claim 13, wherein the electric power is supplied by the vehicle's existing electrical system and the blower means is thermostatically controlled.

15. The forced air helmet defroster system for sport/utility vehicles of claim 9, wherein the delivery conduit further comprises a diffuser adapted to deliver the combined air toward the helmet's face shield.

16. A forced air helmet shield defroster system for sport/utility vehicles comprising:

(a) thermostatically controlled electrically powered blower means, the blower means mounted to the sport/utility vehicle adapted to draw in cold outdoor air, the electrical power for the blower means supplied by the vehicle's existing electrical system;

(b) a cold air intake, conduit, the intake conduit connected to the blower means;

(c) air heating means, the air heating means connected to the intake conduit, the cold outdoor air driven to the air heating means by the blower means, the air heating means adapted to warm the cold outdoor air;

(d) a temperature control junction, the temperature control junction connected to the intake conduit and to the air heating means, the temperature control junction adapted to proportionately combine the cold outdoor air and the warm air, the cold outdoor air and the warm air driven to the temperature control junction by the blower means;

(e) a delivery conduit, the delivery conduit connected to the temperature control junction and extendable to a helmet worn by a rider of the vehicle for delivering the combined air to defrost the helmet shield, the warm air driven through the delivery conduit by the blower means and wherein the delivery conduit has an insulation layer; and (f) a delivery conduit break away connection, the break away connection adapted to allow the delivery conduit to break free from the vehicle.

17. The forced air helmet defroster system for sport/utility vehicles of claim 16, wherein the air heating means further comprises an electrically powered heating element.

18. The forced air helmet defroster system for sport/utility vehicles of claim 16, wherein the air heating means further comprises a heat exchanger attached to a vehicle's exhaust system.

19. The forced air helmet defroster system for sport/utility vehicles of claim 16, wherein the air heating means further comprises an engine coolant water heat exchanger.

20. The forced air helmet defroster system for sport/utility vehicles of claim 16, wherein the temperature control junction further comprises an electrically powered servo-driven butterfly valve adapted to control the proportion of cold outdoor air to warm air, the electrical power for the servo-motor supplied by the vehicle's existing electrical system.

* * * * *